US008596427B2

(12) United States Patent
Numata

(10) Patent No.: US 8,596,427 B2
(45) Date of Patent: Dec. 3, 2013

(54) INSTALLMENT STRUCTURE FOR BRAKING MECHANISM IN POWER TOOL

(75) Inventor: Fumitoshi Numata, Anjo (JP)

(73) Assignee: Makita Corporation, Anjo-shi (JP)

( * ) Notice: Subject to any disclaimer, the term of this patent is extended or adjusted under 35 U.S.C. 154(b) by 242 days.

(21) Appl. No.: 13/156,725

(22) Filed: Jun. 9, 2011

(65) Prior Publication Data

US 2012/0012429 A1 Jan. 19, 2012

(30) Foreign Application Priority Data

Jul. 16, 2010 (JP) ..... 2010-162014

(51) Int. Cl.
*B24B 47/26* (2006.01)

(52) U.S. Cl.
USPC ..... 188/166; 188/171; 451/344; 451/359; 171/141

(58) Field of Classification Search
USPC ..... 188/166, 171; 267/137; 451/344, 359; 173/141
See application file for complete search history.

(56) References Cited

U.S. PATENT DOCUMENTS

2011/0220378 A1* 9/2011 Numata ..... 173/141
2012/0244788 A1* 9/2012 Numata ..... 451/359
2013/0023189 A1* 1/2013 Numata ..... 451/344

FOREIGN PATENT DOCUMENTS

EP 1 938 924 A1 7/2008
EP 2 138 279 A1 12/2009

OTHER PUBLICATIONS

Jul. 16, 2013 Extended European Search Report issued in European Patent Application No. 11169307.3.

* cited by examiner

*Primary Examiner* — Christopher Schwartz
(74) *Attorney, Agent, or Firm* — Oliff & Berridge, PLC

(57) ABSTRACT

An output shaft of a motor is divided into a front shaft (first or second front shaft) and a rear shaft. The first front shaft is to be rotatably supported by a first shaft support plate connected directly to a motor housing. The second front shaft is to be rotatably supported by a second shaft support plate connected to the motor housing with a spacer provided between the second shaft support plate and the motor housing. A braking mechanism including a flange plate, a braking member and a biasing member is mounted to the second shaft support plate and the second front shaft. The first front shaft is used with the first shaft support plate to realize a power tool without the braking mechanism. The second front shaft is used with the second shaft support plate and the spacer to realize a power tool without the braking mechanism.

16 Claims, 5 Drawing Sheets

INSTALLMENT STRUCTURE FOR BRAKING MECHANISM IN POWER TOOL

BACKGROUND OF THE INVENTION

This application claims the entire benefit of Japanese Patent Application Number 2010-162014 filed on Jul. 16, 2010, the entirety of which is incorporated by reference.

TECHNICAL FIELD

The present invention relates to a structure for allowing selection between the presence and the absence of a braking mechanism for braking an output shaft of a motor in a power tool such as a grinder.

BACKGROUND ART

A power tool such as a grinder may include a braking mechanism which is activated to brake an output shaft of a motor at a time when the power tool is switched off. The braking mechanism is typically configured, as disclosed in EP 1938924 A1, to include a first braking disc integrally fixed to a frontward portion of a cooling fan of an output shaft, a second braking disc adapted to be selectably brought into or out of contact with the first braking disc, and a spring pressing the second braking disc against the first braking disc with its elastic biasing force. A slider may be disposed at a housing of the power tool, for allowing a user to switch on and off the power tool by manipulating it. When the slider is slid to a switch-on position, the second braking disc is moved against the elastic biasing force of the spring via a connecting member or the like and separated from the first braking disc, so that brakeage is released. When the slider is slid to a switch-off position, the second braking disc is pressed against the first braking disc by the elastic biasing force of the spring, so that the output shaft of the motor is braked via the first braking disc.

The power tool including a braking mechanism as described above may be configured such that an entire length of an output shaft is elongated frontwardly because the first and second braking disks, springs and other components should additionally be mounted therein; thus, the housing, as well, may necessarily become a frontwardly elongated shape accordingly. Therefore, some constituent parts such as a motor and a housing cannot be designed or used commonly between the power tools with and without the braking mechanism. As a result, it would be necessary to provide different motors and housings, etc. depending upon the presence or absence of the braking mechanism, which increases the costs and managerial tasks.

It would be desirable to provide an installment structure for a braking mechanism in a power tool, in which as many constituent parts other than the braking mechanism as possible can be used in common between two modes of use with and without the braking mechanism, so that the costs and managerial tasks can be reduced significantly.

The present invention has been made in an attempt to eliminate the above disadvantages, and illustrative, non-limiting embodiments of the present invention overcome the above disadvantages and other disadvantages not described above.

SUMMARY OF INVENTION

In a first aspect of the present invention, there is provided an installment structure for a braking mechanism for braking an output shaft of a motor in a power tool. The structure comprises a tubular motor housing and a front housing. The tubular motor housing accommodates the motor. The front housing is mounted frontwardly of the motor housing. A shaft support plate configured to support an output shaft of the motor is provided between the front housing and the motor housing. The shaft support plate has a plurality of types available which includes a first shaft support plate adapted to be connected directly to the motor housing and a second shaft support plate adapted to be connected to the motor housing with a tubular spacer being provided between the second shaft support plate and the motor housing. The output shaft consists of a front shaft to be rotatably supported by the shaft support plate and a rear shaft disposed rearwardly of the front shaft. The front shaft is detachably connected to a rear shaft. The front shaft has a plurality of types available which includes a first front shaft adapted to be rotatably supported by the first shaft support plate and a second front shaft adapted to be rotatably supported by the second shaft support plate. The second front shaft is longer than the first front shaft in an axial dimension. The braking mechanism includes a flange plate, a braking member and a biasing member. The braking mechanism is configured to be mounted to the second shaft support plate and the second front shaft such that the flange plate is fixed to the second front shaft. The braking member is movable between a braking position and a retreating position. The braking position is a position where the braking member is pressed against the flange plate, and the retreating position is a position where the braking member is separate from the flange plate. Further, the biasing member is configured to press the braking member toward the flange plate. Two modes of configuration are implementable which include: a first mode without the braking mechanism in which the first front shaft is connected to the rear shaft with the first shaft support plate being mounted between the motor housing and the front housing; and a second mode with the braking mechanism in which the second front shaft is connected to the rear shaft with the second shaft support plate and the spacer being mounted between the motor housing and the front housing.

In the structure as described above, optionally, as a second aspect, a cooling fan for cooling the motor may be provided at the rear shaft of the output shaft, and a baffle plate may be integrally formed on the spacer, the baffle plate being configured to extend around the cooling fan to a rear side of the cooling fan when the spacer is mounted between the motor housing and the front housing.

The front shaft may have a pit formed at a rear face thereof, and the rear shaft may have a diameter-reduced portion provided at a front end thereof. The front shaft and the rear shaft may be connectable together by press-fitting the diameter-reduced portion of the rear shaft in the pit of the front shaft. The first shaft support plate may have a plurality of ridges provided protrusively at a rear surface thereof. The plurality of ridges at the rear surface of the first shaft support plate may extend concentrically and may be located in proximity to a front surface of the cooling fan to form a labyrinth. The biasing member may include a coil spring.

The motor housing may include a slide control subjected to manipulations which include a forward sliding operation to cause a drive switch of the motor to be turned on. The braking member may be configured to move frontward against a biasing force of the biasing member in accordance with the forward sliding operation applied to the slide control, and separate from the flange plate to thereby release brakeage.

With the configurations described above, various advantageous effects may be expected as follows.

For example, according to one or more aspects of the present invention, as mentioned above particularly in the first aspect, the presence or absence of the braking mechanism can be selected by selection between the first shaft support plate and the second shaft support plate, selection between the first front shaft and the second front shaft with the braking mechanism, and selection between the presence and absence of the spacer. Regardless of whether or not the braking mechanism is incorporated, the other components can be designed to be commonly usable. Accordingly, as many constituent parts other than the braking mechanism as possible can be used in common between two modes of use with and without the braking mechanism, so that the costs and managerial tasks can be reduced significantly.

According to the configuration described in the second aspect, in addition to the advantage described above in relation to the configuration of the first aspect, it is not necessary to newly incorporate a separate baffle plate in the power tool. As a result, the number of components may be reduced, and simplification of the configuration and ease of assembly may be increased.

BRIEF DESCRIPTION OF THE DRAWINGS

The above and other aspects, other advantages and further features of the present invention will become more apparent by describing in detail illustrative, non-limiting embodiments thereof with reference to the accompanying drawings.

DETAILED DESCRIPTION OF THE PREFERRED EMBODIMENTS

An illustrative embodiment of the present invention will be described in detail with reference to the drawings.

Figure 1A:
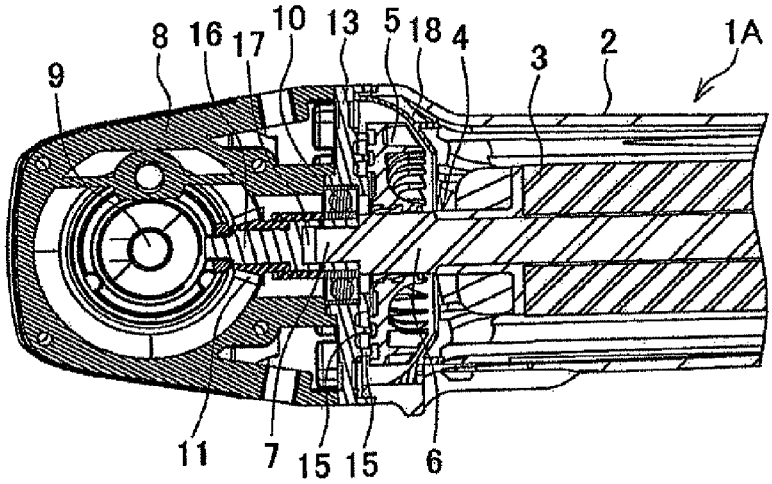
FIG. 1A is a longitudinal section taken along a horizontal plane of a grinder without a braking mechanism.
Figure 1B:
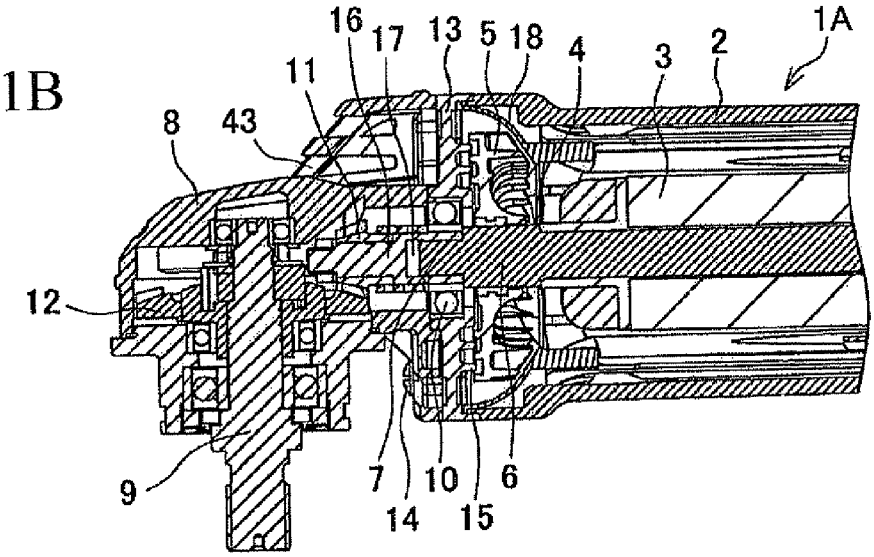
FIG. 1B is a longitudinal section taken along a vertical plane of the grinder shown in FIG. 1A.
Figure 2A:
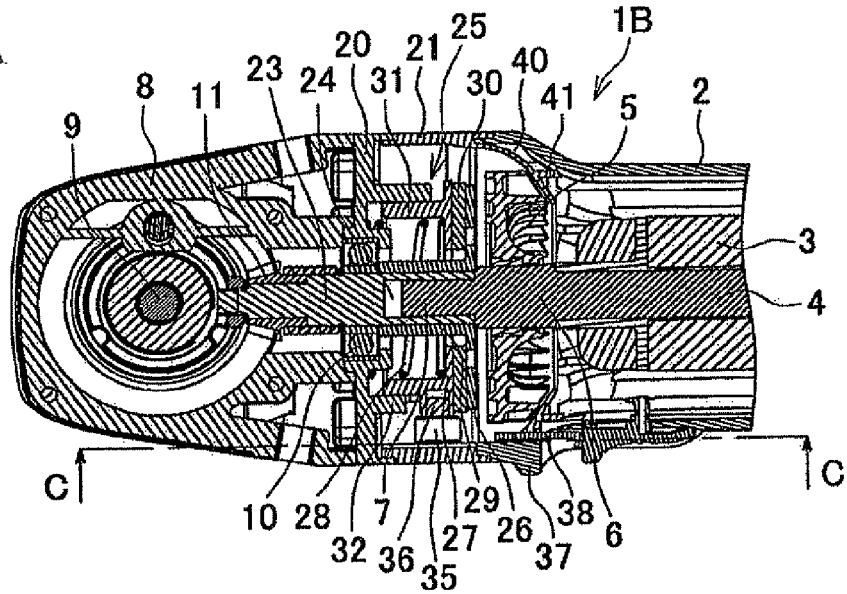
FIG. 2A is a longitudinal section taken along a horizontal plane of a grinder with a braking mechanism.
Figure 2B:
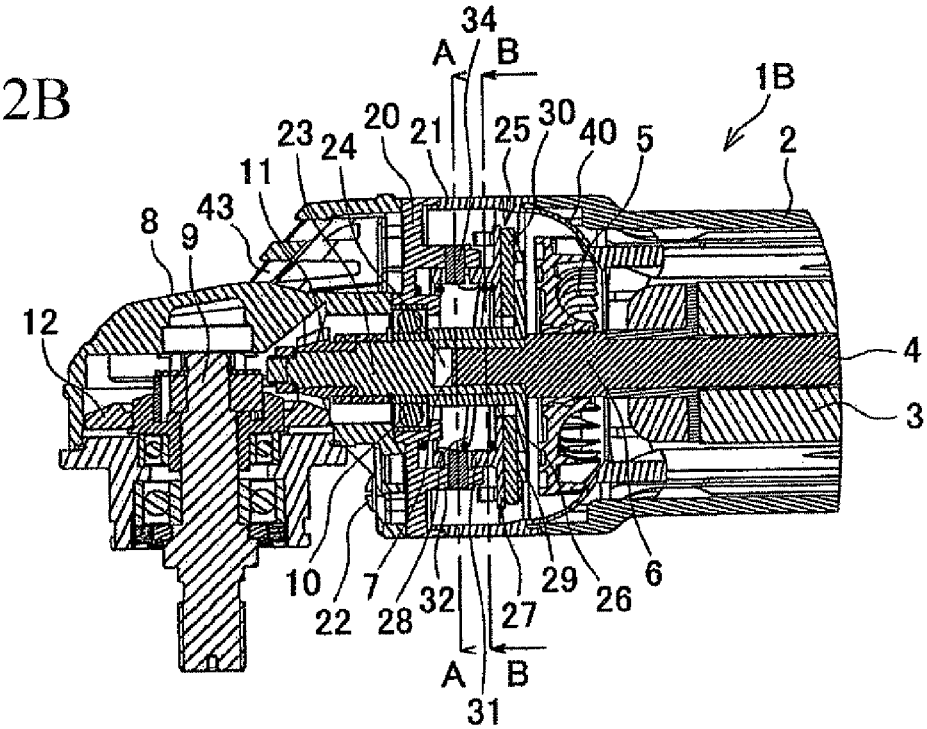
FIG. 2B is a longitudinal section taken along a vertical plane of the grinder shown in FIG. 2A.

Referring to FIGS. 1 and 2, which show an installment structure for a braking mechanism in a grinder as one example of a power tool, a grinder 1A has a configuration without a braking mechanism, and a grinder 1B has a configuration with a braking mechanism.

The common structure of the both configurations will be described at the outset. In a tubular motor housing 2, a motor 3 is accommodated with its output shaft 3 projecting to the front (left side of FIGS. 1 and 2). A cooling fan 5 for the motor 3 is fixed to the output shaft 4, more specifically at a portion of the output shaft 4 near the opening of the motor housing 2 through which the output shaft 4 protrudes. The output shaft 4 has a two-part structure divided at a position slightly frontward of the cooling fan 5 into a front shaft (which will be described later) and a rear shaft 6 to which the cooling fan 5 is fixed. The rear shaft 6 has a diameter-reduced portion 7 provided at a front end thereof.

A front housing 8 configured to support a spindle 9 in a manner that permits the spindle 9 to rotate about an axis thereof in a position perpendicular to the output shaft 4 is mounted frontwardly of the motor housing 2. An end portion of the output shaft 4 rotatably supported on ball bearings 10 protrudes into the front housing 8. A pinion 11 integrally formed on the end portion of the output shaft 4 is engaged with a bevel gear 12 fixed to the spindle 9, so that rotation of the output shaft 4 can be transmitted to the spindle 9. A lower end of the spindle 9 protrudes out from the front housing 8, so that a whetstone (not shown) can be attached thereto.

Next, characteristic configuration of the grinder 1A will now be described in detail. In the grinder 1A, a first shaft support plate 13 that holds the ball bearings 10 is mounted directly to the motor housing 2 by a screw 14 which is screwed from the front side of the front housing 8 into the motor housing 2. A plurality of ridges 15 are provided protrusively at a rear surface of the first shaft support plate 13. The ridges 15 extend concentrically and are located in proximity to a front surface of the cooling fan 5 to form a labyrinth.

The first front shaft 16 of the output shaft 4 has a pit 17 at a rear face thereof, and the diameter-reduced portion 7 of the rear shaft 6 is press-fitted in the pit 17 of the first front shaft 16. A portion of the first front shaft 16 in which the diameter-reduced portion 7 of the rear shaft 6 is press-fitted is rotatably supported on the ball bearings 10. A baffle plate 18 is mounted at a front opening of the motor housing 2 and configured to extend around the cooling fan 5 to a rear side of the cooling fan 5.

Next, characteristic configuration of the grinder 1B will now be described in detail. In the grinder 1B, a second shaft support plate 20 that holds the ball bearings 10, and a tubular spacer 21 located rearward of the second shaft support plate 20 are disposed between the motor housing 2 and the front housing 8 and mounted by a screw 22 which is screwed from the front side of the front housing 8 into the motor housing 2. Accordingly, the distance between the second shaft support plate 20 and the cooling fan 5 becomes longer in the axial direction; for this reason, the second front shaft 23 of the output shaft 4 is designed to have a portion rearward of the ball bearings 10 longer than that of the first front shaft 16 of the output shaft 4 provided in the grinder 1A. The second front shaft 23 of the output shaft 4 has a pit 24 at a rear face thereof, similar to the pit 17 of the first front shaft 16, such that the diameter-reduced portion 7 of the rear shaft 6 is press-fitted in the pit 24 of the second front shaft 23.

Furthermore, a braking mechanism 25 is provided at the second shaft support plate 20 and the second front shaft 23. The braking mechanism 25 includes a circular flange plate 26, a braking member 27 and a coil spring 28. The flange plate 26 is fitted on the rear end of the second front shaft 23. The braking member 27 is disposed frontward of the flange plate 26, and configured to be movable between a braking position and a retreating position. The braking position is a position where the braking member 27 is pressed against the flange plate 26, and the retreating position is a position where the braking member 27 is separate from the flange plate 26. The coil spring 28 is an example of a biasing member configured to press the braking member 27 toward the flange plate 26.

Figure 3B:
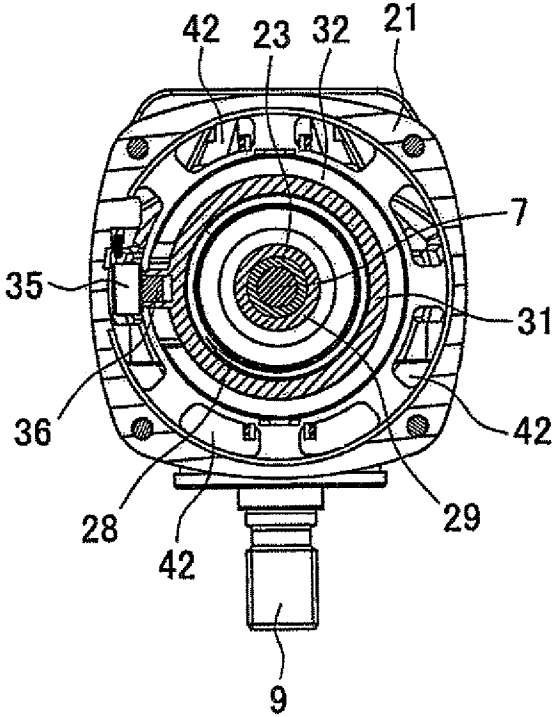
FIG. 3B is a cross section taken along line B-B of FIG. 2B.
Figure 3A:
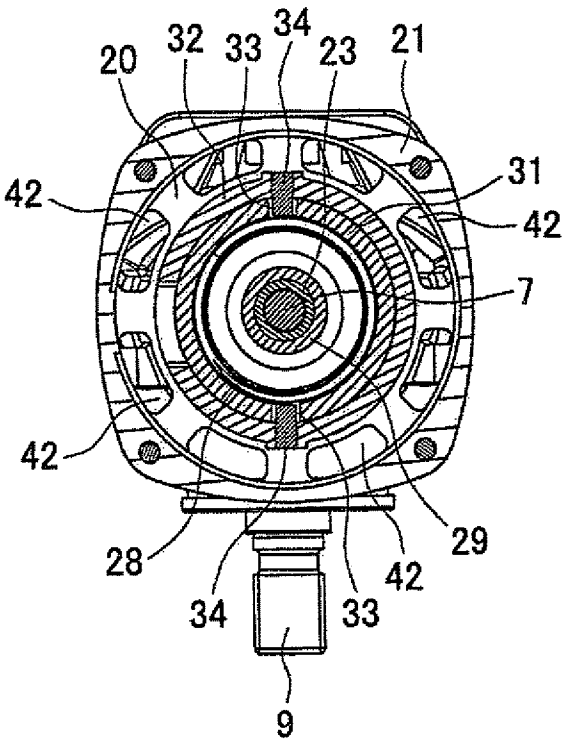
FIG. 3A is a cross section taken along line A-A of FIG. 2B.

The flange plate 26 has a tubular portion 29 which is integrally formed at the center of the flange plate 26 and fitted to the second front shaft 23. Therefore, the flange plate 26 is coupled to the second front shaft 23 so as to rotate together. The braking member 27 is in a shape of a disc, and disposed to face the flange plate 26. A brake shoe 30 is provided at a rear side of the braking member 27. As shown in FIG. 3, a cylindrical portion 31 is provided on the braking member 27, and concentrically protrudes frontward from a front side of the braking member 27. The cylindrical portion 31 is loosely fitted in an annular rib 32 protrusively provided at a rear surface of the second shaft support plate 20.

A pair of helical lead grooves 33 are formed diametrically in the cylindrical portion 31, symmetrically with respect to the axis of the cylindrical portion 31. A pair of guide pins 34 provided on the annular rib 32 are loosely fitted in the lead grooves 33 so that the braking member 27 is guided by the guide pins 34 fitted in the lead grooves 33 and moved frontward or rearward while being rotated. The coil spring 28 is provided inside the cylindrical portion 31 of the braking member 27 between the braking member 27 and the second shaft support plate 20.

Figure 4:
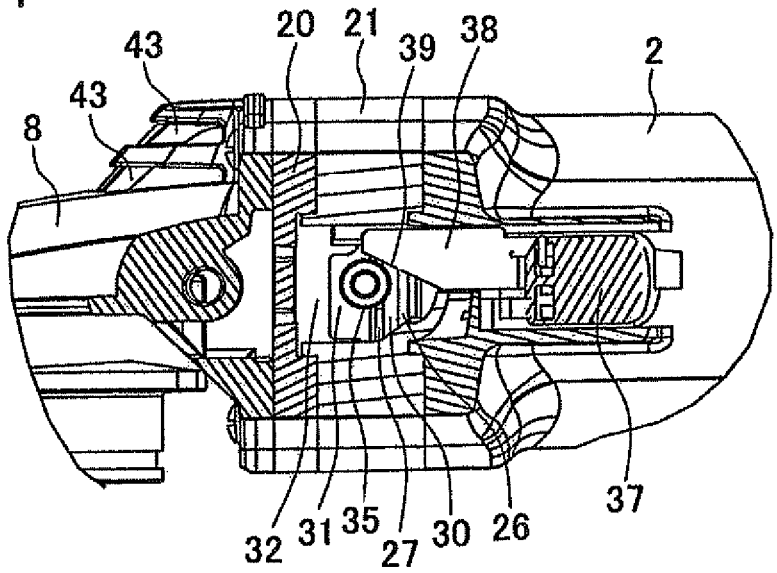
FIG. 4 is a cross section taken along line C-C of FIG. 2A.

A rolling element 35 is provided at an outer peripheral surface of the cylindrical portion 31 and rotatably supported by a support pin 36 which protrudes in a radial direction. Rearwardly of the rolling element 35, as shown in FIG. 4, a slide control 37 is provided slidably along a sidewall of the motor housing 2 forward and backward, and configured to be manipulatable to cause a drive switch of the motor 3 to turn on and off. To be more specific, a connecting bar 38 having an inclined surface 39 provided at an end thereof is connected integrally with the slide control 37, and configured such that the inclined surface 39 comes in contact with the rolling element 35 when the slide control 37 is slid forward to cause the drive switch to be turned on.

Figure 5A:
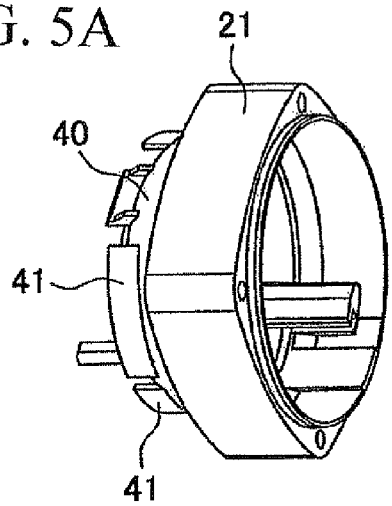
FIG. 5A is a perspective view of a spacer.
Figure 5B:
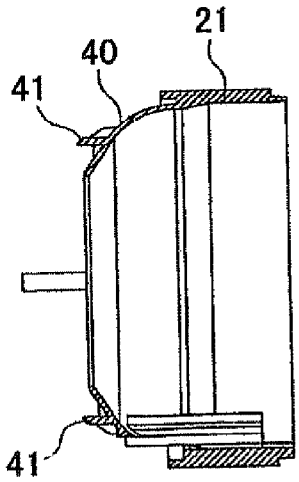
FIG. 5B is a longitudinal section of the spacer.
Figure 5C:
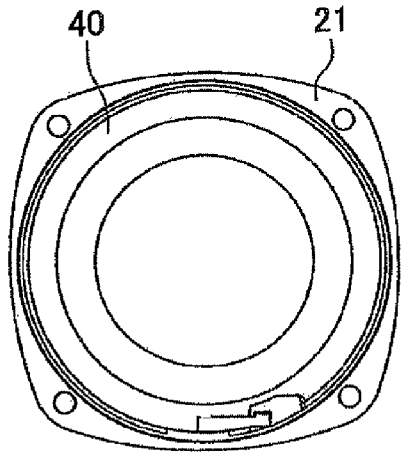
FIG. 5C is a front elevation of the spacer.

A baffle plate 40 is provided at the rear end of the spacer 21 and integrally formed with the spacer 21. The baffle plate 40 is configured to extend around the cooling fan 5 to a rear side of the cooling fan 5 when the spacer 21 is mounted to the motor housing 2. The baffle plate 40 is, as shown in FIG. 5B, shaped like a dish having an opening provided at the center of the baffle plate 40 with a diameter gradually reduced toward rearward. A plurality of ribs 41 are formed to extend circumferentially on a rear surface of the baffle plate 40, and configured to come in contact with an inner surface of the motor housing 2. With these ribs 41, the baffle plate 40 is supported in such a position that the inner surface of the baffle plate 40 contoured to fit the shape of the cooling fan 5 is located in proximity to the rear end of the cooling fan 5, so that air passed inside the motor housing 2 by the cooling fan 5 is forwarded to the front. A plurality of through holes 42 each having a circumferentially elongated shape are provided in the second shaft support plate 20, at positions near the peripheral edge of the second shaft support plate 20. Cooling air is directed to pass through these through holes 42 and discharged from an air vent 43 formed in the front housing 8 to the outside. Through holes similar to the through holes 42 are provided in the first shaft support plate 13 at positions near the peripheral edge of the first shaft support plate 13.

With the above-described installment structure for a braking mechanism in a grinder, when the grinder 1A without the braking mechanism 25 is desired, the following assembly process is carried out. First, the first front shaft 16 is connected to the rear shaft 6 to which the baffle plate 18 is mounted and the cooling fan 5 is fixed, and the resultant assembly is supported with the output shaft 4 including first front shaft 16 plus rear shaft 6, placed rotatably in the first shaft support plate 13; then, the motor 3 is put into the motor housing 2 from the front side, and the first shaft support plate 13 is directly mounted to the front end of the motor housing 2. Finally, the front housing 8 to which the spindle 9 and other components are mounted is screwed to the motor housing 2 from the front side of the first shaft support plate 13. In this way, the grinder 1A without a braking mechanism is obtained.

On the other hand, when the grinder 1B with the braking mechanism 25 is desired, the following assembly process is carried out. First, the braking mechanism 25 is mounted between the second shaft support plate 20 and the second front shaft 23, and the second front shaft 23 is rotatably supported in the second shaft support plate 20; then, the second front shaft 23 is connected to the rear shaft 6 to which the cooling fan 5 is fixed. Accordingly, the braking mechanism 25 is mounted to the end of the output shaft 4. After the spacer 21 is mounted to the motor housing 2, the motor 3 is put into the motor housing 2 from the front side, and the second shaft support plate 20 is mounted to the front end of the spacer 21. Finally, the front housing 8 to which the spindle 9 and other components are mounted is screwed to the motor housing 2 from the front side of the second shaft support plate 20. In this way, the grinder 1B with the braking mechanism 25 is obtained.

In this grinder 1B, at the initial stage in operation where the slide control 37 is in a rear position (i.e., OFF position), the braking member 27 is in a retreating position in which the brake shoe 30 is pressed against the flange plate 26 by the action (biasing force) of the coil spring 28. When the slide control 37 is slid forward to activate the motor 3, the connecting bar 38 is moved and the inclined surface 39 of the connecting bar 38 is brought into contact with the rolling element 35, and presses the rolling element 35. Then, the braking member 27 is moved frontward against the biasing force of the coil spring 28 while being rotated counterclockwise as viewed from rearward because the guide pins 34 are slid relatively in the lead grooves 33. Accordingly, the brake shoe 30 is separated from the flange plate 26, and thus the brakeage on the flange plate 26 is released and the output shaft 4 becomes rotatable. By causing the flange plate 26 to be moved frontward while being rotated, the force applied to the slide control 37 can be reduced, and the operational ease at the startup can be improved.

When the slide control 37 is slid backward to stop the motor 3, the braking member 27, in which the pressing (biasing) force by the connecting bar 38 against the rolling element 35 was released until then, is moved rearward while being rotated clockwise as viewed from rearward by the action of the coil spring 28 with the help of the guidance of the lead grooves 33 and the guide pins 34 configured to be slidable relative to each other. As a result, the brake shoe 30 is pressed against the flange plate 26. Accordingly, the flange plate 26 is braked and the output shaft 4 is stopped immediately. In this operation, the braking member 27 is being rotated in a direction reverse to the rotation of the output shaft 4 when the brake shoe 30 is brought into contact with the flange plate 26; therefore, the brakeage on the output shaft 4 can be more effective.

As described above, the installment structure for the braking mechanism 25 in the grinder according to the present embodiment is configured such that the output shaft 4 of the motor 3 consists of the front shaft and the rear shaft 6. The front shaft has a plurality of types available which includes the first front shaft 16 adapted to be rotatably supported by the first shaft support plate 13 connected directly to the motor housing 2 and the second front shaft 23 adapted to be rotatably supported by the second shaft support plate 20 connected to the motor housing 2 with the tubular spacer 21 being provided between the second shaft support plate 20 and the motor housing 2. The second front shaft 23 is longer than the first front shaft 16 in an axial dimension, wherein the braking mechanism 25 includes the flange plate 26, the braking member 27 and the coils spring 28. The braking mechanism 25 is installable to the second shaft support plate 20 and the second front shaft 23 in the grinder 1B with a configuration in which the flange plate 26 is fixed to the second front shaft 23. The braking member 27 is movable between a braking position and a retreating position. The braking position is a position where the braking member 27 is pressed against the flange plate 26. The retreating position is a position where the braking member 27 is separate from the flange plate 26. The coil spring 28 is configured to press the braking member 27 toward the flange plate 26, whereby two modes of configuration is implementable which include: a first mode without the braking mechanism 25 in which the first front shaft 16 is connected to the rear shaft 6 with the first shaft support plate 13 being mounted between the motor housing 2 and the front housing 8; and a second mode with the braking mechanism 25 in which the second front shaft 23 is connected to the rear shaft 6 with the second shaft support plate 20 and the spacer 21 being mounted between the motor housing 2 and the front housing 8.

With this configuration, the presence or absence of the braking mechanism 25 can be selected by selection between the first shaft support plate 13 and the second shaft support plate 20, selection between the first front shaft 16 and the second front shaft 23 with the braking mechanism 25, and selection between the presence and absence of the spacer 21. Regardless of whether or not the braking mechanism 25 is incorporated, the other components can be designed to be commonly usable irrespective. Accordingly, as many constituent parts other than the braking mechanism 25 as possible can be used in common between two modes of use with and without the braking mechanism 25, so that the costs and managerial tasks can be reduced significantly.

Particularly, in the present embodiment, the baffle plate 40 configured to extend around the cooling fan 5 to the rear side of the cooling fan 5 when the spacer 21 is mounted to the motor housing 2 is integrally formed on the spacer 21. Thus, it is not necessary to newly incorporate a separate baffle plate 40 in the grinder. As a result, the number of components may be reduced, and simplification and ease of assembly may be increased.

The method of connecting the front and rear shafts is not limited to the above-described specific configuration. For example, the diameter-reduced portion and the pit may be reversely provided; i.e., the former may be provided at the rear end of the front shaft and the latter may be provided at the front end of the rear shaft. Any connecting means such as a pin or a screw may be adopted to connect the front and rear shafts, instead of press-fitting the shafts.

Arrangement of the complementary pair of parts in the braking mechanism, for example, the lead groove/guide pin pair, the rolling element/inclined surface pair may also be reversed. The rolling element may be omitted and the braking member may also be provided with an inclined surface which is disposed to cause the braking member to be moved while being rotated with the help of the inclined surfaces provided on the braking member and the connecting bar. The braking member may not be rotated. The braking member may be caused to tilt or move to-and-fro in accordance with the sliding operation of the slide control so that a braking mechanism is realized in which the braking member is brought into contact with or separated away from the flange plate.

The baffle plate may not necessarily be provided integrally with the spacer. The baffle plate may be separately provided and incorporated in the motor housing.

Furthermore, the power tool consistent with the present invention is not limited to a grinder, but the present invention may be applied to a sander or other kind of power tool.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims.

What is claimed is:

1. An installment structure for a braking mechanism for braking an output shaft of a motor in a power tool, the structure comprising:

a tubular motor housing accommodating the motor; and a front housing mounted frontwardly of the motor housing with a shaft support plate configured to support an output shaft of the motor being provided between the front housing and the motor housing, the shaft support plate having a plurality of types available which includes a first shaft support plate adapted to be connected directly to the motor housing and a second shaft support plate adapted to be connected to the motor housing with a tubular spacer being provided between the second shaft support plate and the motor housing, the output shaft consists of a front shaft to be rotatably supported by the shaft support plate and a rear shaft disposed rearwardly of the front shaft, the front shaft being detachably connected to a rear shaft, the front shaft having a plurality of types available which includes a first front shaft adapted to be rotatably supported by the first shaft support plate and a second front shaft adapted to be rotatably supported by the second shaft support plate, the second front shaft being longer than the first front shaft in an axial dimension, wherein the braking mechanism includes a flange plate, a braking member and a biasing member, and is configured to be mounted to the second shaft support plate and the second front shaft such that the flange plate is fixed to the second front shaft, the braking member is movable between a braking position in which the braking member is pressed against the flange plate and a retreating position in which the braking member is separate from the flange plate, and the biasing member is configured to press the braking member toward the flange plate, whereby two modes of configuration are implementable which include: a first mode without the braking mechanism in which the first front shaft is connected to the rear shaft with the first shaft support plate being mounted between the motor housing and the front housing; and a second mode with the braking mechanism in which the second front shaft is connected to the rear shaft with the second shaft support plate and the spacer being mounted between the motor housing and the front housing.

2. The structure according to claim 1, wherein the motor housing includes a slide control subjected to manipulations which include a forward sliding operation to cause a drive switch of the motor to be turned on.

3. The structure according to claim 2, wherein the braking member is configured to move frontward against a biasing force of the biasing member in accordance with the forward sliding operation applied to the slide control, and separate from the flange plate to thereby release brakeage.

4. The structure according to claim 3, wherein the braking member includes a cylindrical portion provided at a front surface thereof, the second shaft support plate includes an annular rib provided at a rear surface thereof, the cylindrical portion of the braking member being engaged with the annular rib of the second shaft support plate, and a guide pin is formed on one of the cylindrical portion and the annular rib and a helical lead groove configured to allow the guide pin to be loosely fitted therein is formed on the other of the cylindrical portion and the annular rib, whereby the braking member is caused to move frontward while being rotated by guidance of the lead groove given to the guiding pin in accordance with the forward sliding operation applied to the slide control.

5. The structure according to claim 4, wherein the lead groove is formed to extend in such a direction that the braking member is brought into contact with the flange plate while being rotated in a direction reverse to that of rotation of the output shaft in accordance with the forward sliding operation applied to the slide control.

6. The structure according to claim 5, wherein the braking mechanism further includes a connecting bar having an inclined surface provided at an end thereof, the connecting bar being connected to the slide control, the braking member includes a rolling element provided at a peripheral edge of the braking member, and the inclined surface of the connecting bar moved frontward in accordance with the forward sliding operation of the slide control causes the rolling element of the braking member in contact with the inclined surface to relatively roll along the inclined surface, whereby the braking member is caused to move frontward while being rotated.

7. The structure according to claim 4, wherein the braking mechanism further includes a connecting bar having an inclined surface provided at an end thereof, the connecting bar being connected to the slide control, the braking member includes a rolling element provided at a peripheral edge of the braking member, and the inclined surface of the connecting bar moved frontward in accordance with the forward sliding operation of the slide control causes the rolling element of the braking member in contact with the inclined surface to relatively roll along the inclined surface, whereby the braking member is caused to move frontward while being rotated.

8. The structure according to claim 1, wherein a cooling fan for cooling the motor is provided at the rear shaft of the output shaft, and a baffle plate is integrally formed on the spacer, the baffle plate being configured to extend around the cooling fan to a rear side of the cooling fan when the spacer is mounted between the motor housing and the front housing.

9. The structure according to claim 8, wherein the front shaft has a pit formed at a rear face thereof, and the rear shaft has a diameter-reduced portion provided at a front end, the front shaft and the rear shaft connectable together by press-fitting the diameter-reduced portion of the rear shaft in the pit of the front shaft.

10. The structure according to claim 8, wherein the first shaft support plate has a plurality of ridges provided protrusively at a rear surface thereof, the plurality of ridges at the rear surface of the first shaft support plate extending concentrically and located in proximity to a front surface of the cooling fan to form a labyrinth.

11. The structure according to claim 8, wherein the baffle plate includes a plurality of ribs provided at a rear surface of the baffle plate and configured to be in contact with an inner surface of the motor housing.

12. The structure according to claim 8, wherein the shaft support plate has a through hole through which cooling air produced by the cooling fan is allowed to pass.

13. The structure according to claim 1, wherein the front shaft has a pit formed at a rear face thereof, and the rear shaft has a diameter-reduced portion provided at a front end thereof, the front shaft and the rear shaft connectable together by press-fitting the diameter-reduced portion of the rear shaft in the pit of the front shaft.

14. The structure according to claim 1, wherein the biasing member includes a coil spring.

15. The structure according to claim 1, wherein a brake shoe is provided at a rear surface of the braking member.

16. The structure according to claim 1, wherein the front housing is configured to support a spindle in a manner that permits the spindle to rotate about an axis thereof in a position perpendicular to the front shaft, the spindle includes a bevel gear engageable with the front shaft, and an attachment provided at an end of the spindle to allow a discal tool to be installed thereon when the spindle is disposed to protrude out of the front housing with the bevel gear engaged with the front shaft and the attachment located outwardly beyond the front housing.

* * * * *